United States Patent [19]

Fitzner et al.

[11] Patent Number: 4,898,087

[45] Date of Patent: Feb. 6, 1990

[54] LAMINARIZER

[75] Inventors: Klaus Fitzner, Betzdorf; Walter Betz, Siegen; Uwe Plitt, Kirchen; Wolfgang Schmitt, Betzdorf, all of Fed. Rep. of Germany

[73] Assignee: Heinrich Nickel GmbH, Betzdorf, Fed. Rep. of Germany

[21] Appl. No.: 325,363

[22] Filed: Mar. 17, 1989

[30] Foreign Application Priority Data

Aug. 17, 1988 [DE] Fed. Rep. of Germany ..... 3827918

[51] Int. Cl.[4] ..... F24F 7/10

[52] U.S. Cl. ..... 98/40.1; 55/385.2; 55/414; 55/484

[58] Field of Search ..... 55/385.2, 410, 413, 55/414, 416, 484; 98/31, 33.1, 39.1, 40.1

[56] References Cited

U.S. PATENT DOCUMENTS

| | | | |
|---|---|---|---|
| 2,221,001 | 11/1940 | Lucius | 98/40.1 X |
| 2,276,788 | 3/1942 | Norris | 98/40.1 |
| 4,175,936 | 11/1979 | Lough et al. | 55/413 X |
| 4,276,731 | 7/1981 | Henggeler et al. | 55/484 |
| 4,371,386 | 2/1983 | DeVecchi | 98/40.1 X |
| 4,710,208 | 12/1987 | Ziemer et al. | 55/484 X |

FOREIGN PATENT DOCUMENTS

| | | | |
|---|---|---|---|
| 3176944 | 7/1988 | Japan | 55/410 |

*Primary Examiner*—Harold Joyce
*Attorney, Agent, or Firm*—Toren, McGeady & Associates

[57] ABSTRACT

A laminarizer or arrangement for producing laminar flow, particularly for ceilings and walls of clean rooms or the link formed of filter modules. The laminarizer is suspended or held spaced from a cover supporting mechanical filters. The laminarizer is composed of rectangular frames with fabric sheets stretched onto the rectangular frames. The side members of the rectangular frames are hollow sections or angle sections of triangular cross-section. The fabric sheets rest against and are aligned by the surfaces of the side members facing the rooms are only as narrow and/or rounded-off alignment contacts for the fabric sheets, while the fastening of the fabric sheets is provided at the outer surfaces of the side members extending perpendicularly to the plane of the frame and/or on the rear surfaces of the side members extending in the plane of the frame.

26 Claims, 7 Drawing Sheets

LAMINARIZER

BACKGROUND OF THE INVENTION

1. Field of the Invention

The present invention relates to a laminarizer or arrangement for producing laminar flow, particularly for ceilings and walls of clean rooms or the like formed of filter modules. The laminarizer is suspended or held spaced from a cover supporting mechanical filters. The laminarizer is composed of rectangular frames with fabric sheets stretched onto the rectangular frames. The side members of the rectangular frames are hollow sections or angle sections which are triangular in cross-section. The fabric sheets rest against and are aligned by the surfaces of the sections facing the room.

2. Description of the Related Art

Filter modules for ceilings and walls or the like of clean rooms are already known from German Utility Model No. 87 10 781. In these filter modules, a cover carrying mechanical filters is supported by rectangular frames which are arranged at a distance from the cover. Fabric sheets are stretched onto the frames. The fabric sheets create a slight pressure increase which, in turn, has the effect that the filtered air flows in practically equal quantities through a plurality of fine meshes, so that a laminar piston-type flow is created on the outlet side.

The laminarizers formed by the rectangular frames and the fabric sheets resting on the frames have in the past already been constructed in such a way that the frames have on the outlet side only a small cross-section, so that transverse flows and turbulences are prevented which could keep any impurities which have reached the clean room in suspension.

In the known laminarizers, fabric sheets are glued together in the aligned position at the surfaces of the triangular hollow sections or angle sections facing the room. On the other hand, when these laminarizers are mounted, in front of the outlet side of the filter modules of ceilings or walls or the like of clean rooms, the gaps between the outer surfaces of adjacent rectangular frames facing each other are completely sealed or are reduced to defined passage cross-sections.

However, practical experience with laminarizers in which filter modules according to the German Utility Model No. 87 10 781 are used, has shown that in the edge zones of these laminarizers bordered by the rectangular frames as well as in the region of the gap between the frames of adjacent laminarizers, certain disturbances of the flow are created which impair the perfect formation of a laminar piston-type flow in the room.

It is, therefore, the primary object of the present invention to provide a laminarizer of the above-specified type in which not only with particularly simple means the possible flow disturbances at the outlet side are further minimized, but in which also the stability or strength of the connection between the rectangular frames and the fabric sheets is improved.

SUMMARY OF THE INVENTION

In accordance with the present invention, in a laminarizer of the above-described type, the surfaces of the rectangular frame side members facing the room serve only as narrow and/or rounded-off alignment contacts for the fabric sheets, while the fastening of the fabric sheets is provided at the outer surfaces of the rectangular frame side members extending perpendicularly to the plane of the frame and/or on the rear surfaces of the rectangular frame side members extending in the plane of the frame.

As a result of the above-described measures, the surfaces of the rectangular frames facing the room can be shaped like a slightly rounded-off cutting edge-type surface, so that the formation of turbulent regions and turbulent flows resulting therefrom are reduced. However, the size of the surfaces for fastening the fabric sheets can be increased substantially as required, so that the strength of the connection of the fabric sheets with the rectangular frame is substantially improved.

In accordance with another feature, as is also the case in German Utility Model No. 87 10 781, a glued connection can be provided for fastening the fabric sheets.

In accordance with a further feature of the present invention, the glued connection between the side members of the rectangular frame and the fabric sheet is a surface-to-surface glued connection. However, the glued connection may also be effected by means of adhesive strands, for example, of fusion adhesive, placed in longitudinal indentations, for example, undercut grooves, of the side members of the rectangular frame, wherein the fabric sheet is glued by melting at the open side of the longitudinal indentation.

In accordance with another advantageous feature, the fabric sheets are releasably fastened by means of rim profiles and/or sealing profiles arranged in longitudinal indentations, for example, undercut grooves of the rectangular frame side members.

The rim profiles may have a sealing lip formed integrally with the profile which projects elastically deformably from the outer surface of the side member of the rectangular frame.

In accordance with another important further development of the invention, the fabric sheets are fastened to the side members of the rectangular frame at a distance from the rim or border edges of the sheets, wherein the unfastened border strips extend away or project web-like or flag-like and/or arc-shaped from the outer surfaces of the side members of the rectangular frames.

The web-like or flag-like and/or arc-shaped border strips of the fabric sheets as well as the sealing lips of the profiles may project into a gap between adjacent rectangular frames and may contact each other within this gap, so that a defined permeability is created by the border strips or sealing lips in the gap. The flow made possible through the gap between adjacent side members of the rectangular frames reduces in an advantageous manner the turbulences in the flow following the frame.

In accordance with another feature of the present invention, the fabric sheets are attached to the rectangular frames in such a way that the fabric sheets sag or hang in an arch-like shape. The height of the arch of the fabric sheet is approximately between 20 and 30 mm.

In accordance with a structurally simple embodiment of the laminarizers, the rectangular frame side members are connected to each other by means of corner angles. The corner angles have legs which are angularly spaced from each other by between 90° and 91°, preferably between 90°10′ and 90°20′. The rectangular frame side members are connected to each other so as to be under convex or outwardly arched, elastic pretensioning.

When the rectangular frames constructed in this manner are equipped with the fabric sheets, the tensioning of the fabric sheets results in a force acting on the frame side members which tend to force the convexly arched rectangular frame side members into the stretched position thereof without resulting in a subsequent concave or inwardly directed bending of the rectangular frame side members. This advantageously increases the value of the laminarizers.

In order to further simplify the laminarizers, another feature of the present invention provides that the legs of the corner angles are held together with the rectangular frame side members in a press fit connection, so that no additional connecting means are required.

In accordance with another important further development of the invention, the corner angles have in the outer corner region thereof a wall portion which extends parallel to the plane of the frame and which is provided with quarter-circle shaped intended breaking points and, thus, defines limited break-out areas. The removal of these break-out areas from four adjacent corner angles results in a circular passage that is required, for example, for energy supply lines or also for the mounting of sprinkler units. Adjacent the break-out areas and in the inner corner region of the corner angles, the corner angles may also have circular passages which are directed transversely to the principal plane thereof, wherein a fastening element each for the laminarizer can be passed through the circular passage.

In laminarizers which are fastened to a ceiling by means of suspension rods or tensioning rods which at the lower ends thereof have a support plate by means of which the adjacent corners of four rectangular frames can be brought into releasable engagement, the invention further provides that the support plate may have engagement means for a corner each of four adjacent rectangular frames each of which is placed at or on the support plate so as to be slidable in longitudinal direction and transverse direction by a limited extent.

In accordance with a useful feature of the present invention, the engagement means are nuts which are movable within cages, wherein screws extending through the corner pieces of the rectangular frames can be screwed into the nuts. The engagement means in the cages may also be bayonet-type or annular locking means which can be engaged with appropriate opposite members which extend through the corner pieces of the rectangular frames.

The laminarizer which has a fastening means to the ceiling consisting of suspension rods or tensioning rods or tensioning rods may also include support plates for a grid of strips formed of sheet metal sections which serve to receive cover plates by means of which the frames of the mechanical filters for the filter modules can be covered. In accordance with the present invention, in such a laminarizer, the joints of the strips can be sealed by sheet metal sheets glued to the bottom of the strips.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

BRIEF DESCRIPTION OF THE DRAWING

In the drawing:

FIGS. 15 and 16 are a top view and a side view, respectively, showing features of a grid of strips to be mounted above the laminarizers for supporting the filter modules of a clean room ceiling or the like.

DESCRIPTION OF THE PREFERRED EMBODIMENTS

Figure 1:
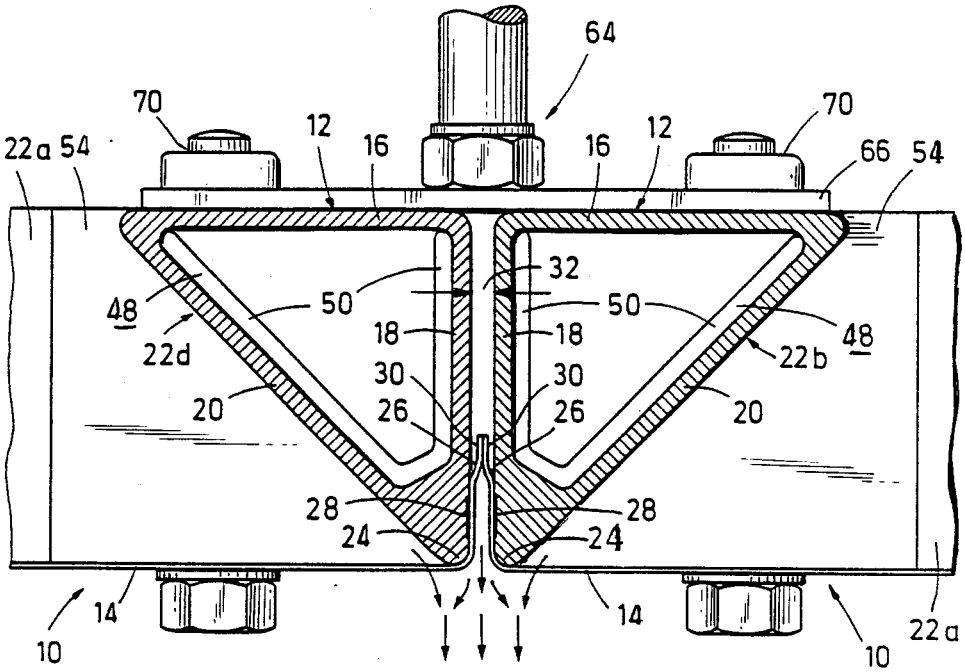
FIG. 1 is a partial sectional view of the corner regions of two laminarizers according to the present invention suspended underneath a filter module for clean rooms or the like, the laminarizers including rectangular frames of hollow sections which are triangular in cross-section.

In so-called clean rooms, the air for conditioning the interior of the room is supplied through filter modules which are mounted underneath the room ceiling and/or in front of the room walls.

In order to obtain a uniform, low-turbulence flow within the clean room despite the presence of mechanical filters which are arranged spaced apart from each other in the clean room, so-called laminarizers 10 are arranged in front of the filter modules in a plane which is spaced apart from the filter modules. The laminarizers 10 are partially illustrated in FIGS. 1 and 2 of the drawing.

A large number of such laminarizers 10 of prefabricated standard size are grouped closely next to each other and are mounted in such a way that they are placed in front of at least the major surface portion of a room ceiling or a room wall.

Each laminarizer 10 includes a rectangular frame 12 and at least one fine-mesh fabric sheet 14 which is stretched over the rectangular frame 12. The fabric sheet 14 may be formed, for example, of a metal fabric and/or a plastic fabric.

As shown in FIG. 1 of the drawing, each rectangular frame 12 is composed of a hollow section which is approximately triangular in cross-section. The hollow section may be a metal section or an extruded plastic section. Two section walls 16 and 18 of the triangular sections extend at a right angle relative to each other, while the third wall 20 extends at an acute angle or obliquely relative to the walls 16 and 18.

Figure 10:
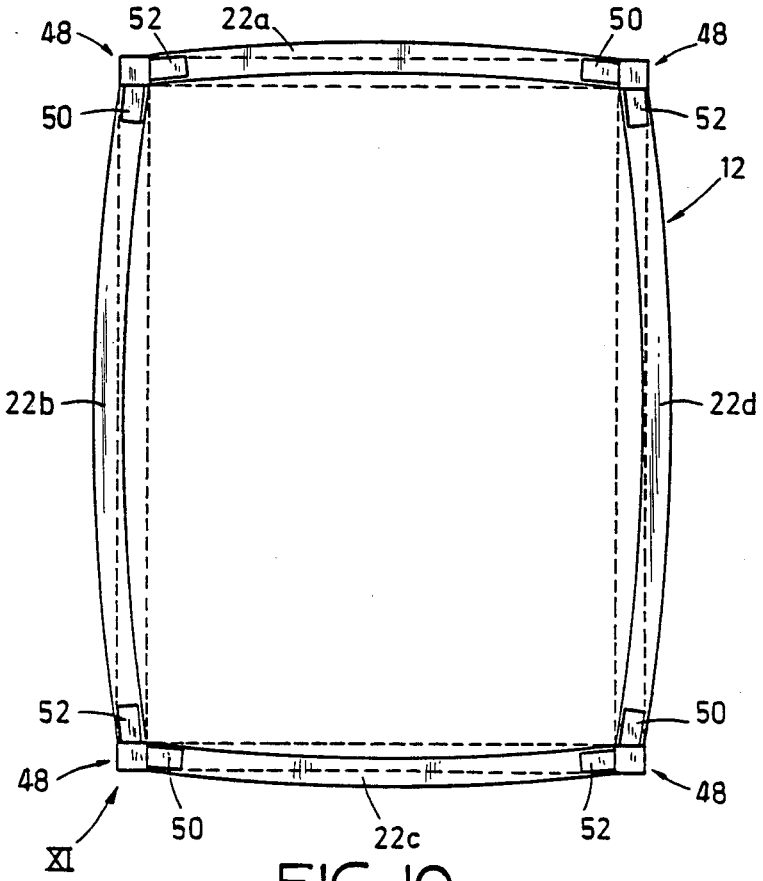
FIG. 10 is a schematically simplified top view of a rectangular frame of a laminarizer, the solid lines showing the frame when the sheets are not stretched onto the frame while the broken lines show the frame, in exaggerated form, when the fabric sheets are stretched onto the frame.

As shown in FIG. 10, the rectangular frame 12 has four side members 22*a*, 22*b*, 22*c*, 22*d*. The walls 18 of the sections form the outer surfaces of the side members.

The section walls 16, on the other hand, form the rear surfaces of the side members 22*a* to 22*d* of the rectangular frame 12, while the inner surfaces are formed by the obliquely extending walls 20.

The end face of each rectangular frame 12 is defined by the vertex zone 24 of the two intersecting section walls 18 and 20. As a result, the vertex zone 24 is very narrow. However, to avoid a sharp edge, the vertex zone 24 is provided with narrow rounded-off surfaces, as clearly shown in FIG. 1.

As can also be seen in FIG. 1, the vertex zone 24 of each side member 22*a* to 22*d* of the rectangular frame 12 forms a contact surface for aligning the fabric sheets 14. The fabric sheets 14 are cut to size in such a way that when the sheets are stretched, border strips 26 of the sheets can be guided around the vertex zone 24 of the side member 22*a* through 22*d* of the rectangular frame 12 and can be brought into contact with the section walls 18 forming the outer surfaces of the rectangular frame 12.

The fabric sheets 14 are also fastened to the section walls 18 which form the outer surfaces of the rectangular frame. In the embodiment shown in FIG. 1, the fastening is by means of glued connections 28 which provide a fixed connection of the fabric sheets 14 with the rectangular frame 12.

The glued connections 28 are located on the outer surfaces of the side members 22*a* through 22*d* of the rectangular frame in such a way that non-attached portions 30 of the border strips remain which project web-like from the surfaces of the side members 22*a* through 22*d*.

The web-like portions 30 can also be seen in FIG. 1 of the drawing.

Adjacent laminarizers 10 are mounted in such a way that, as shown in FIG. 1, only a small gap 32 of a few millimeters remains between the outer surfaces formed by the section walls 18 of the side members 22*a* through 22*d* of the rectangular frame 12.

The web-like portions 30 of the border strips of the fabric strips 14 contact each other within the gap 32 and, thus, form a defined permeability in the gap 32 between adjacent laminarizers 10. The interaction of these defined permeabilities with the oblique section walls 20 serving as flow guide surfaces ensures that in the region between two adjacent laminarizers 10 practically no turbulent regions can be formed which would lead to an undesired turbulent flow.

Figure 2:
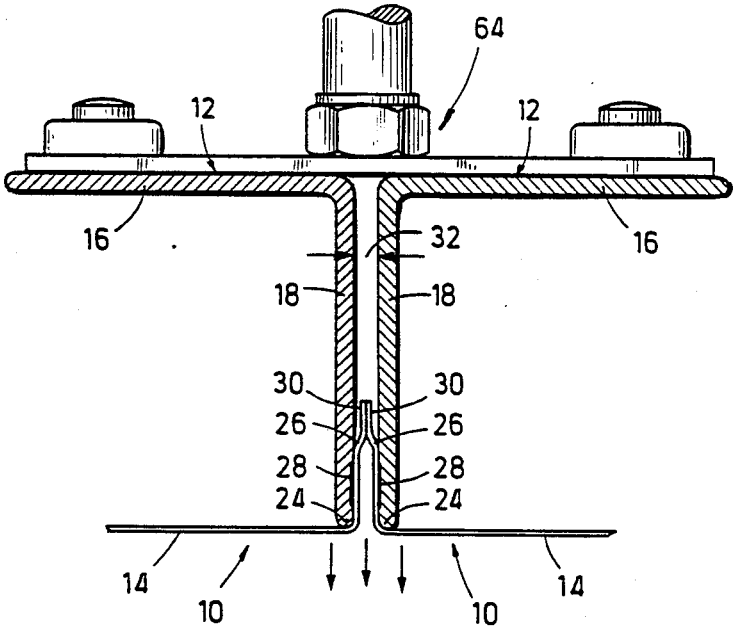
FIG. 2 is a partial sectional view similar to FIG. 1, however, the rectangular frames are angle sections.

As FIG. 2 of the drawing shows, the side members 22*a* to 22*d* of the rectangular frame 12 do not necessarily have to be hollow sections of triangular cross-section. On the contrary, as seen in FIG. 2, the side members can also be formed by simple angle sections which merely have section walls 16 and 18 which extend perpendicularly to each other. In other words, the section does not have the oblique section wall 20.

In the embodiment shown in FIG. 2 it must only be ensured that the section walls 18 of the angle sections have at the longitudinal edges thereof rounded-off vertex zones 24 which ensure that the fabric sheets 14 with the border strips 26 can be pulled around the longitudinal edges without being damaged.

Also, in the embodiment in FIG. 2, the fabric sheets 14 are fastened by means of glued connections 28 of the border strips 26 in such a way that web-like portions 30 remain. The web-like portions project into the gap 32 in such a way that they contact each other and result in the desired, defined permeability in the gap.

Figure 3:
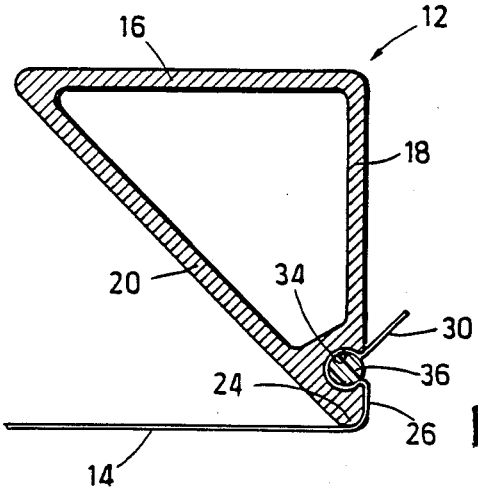
FIG. 3 is a sectional view of a triangular side member of a rectangular frame of different construction as compared to FIG. 1.
Figure 4:
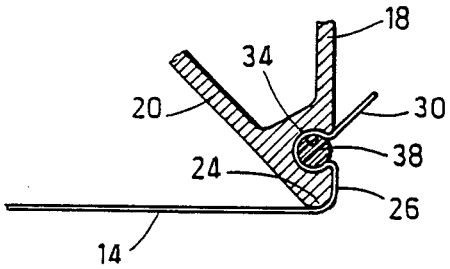
FIG. 4 is a partial view, corresponding to FIG. 3, of another triangular side member.

FIGS. 3 and 4 of the drawings show different types of connections for the fabric sheets 14 and the side members 22*a* to 22*d* of the rectangular frame 12. Contrary to the embodiment shown in FIGS. 1 and 2, the section wall 18 forming the outer surface of the rectangular frame 12 has formed in it a longitudinal indentation or recess 34 in the form of a circular, undercut groove which extends uninterrupted over the entire length of the section. The border strips 26 of the fabric sheets 14 can be secured in this undercut groove or longitudinal recess 34 by means of a so-called rim profile 36 which can be forced or pressed into the longitudinal recess 34 together with the adjacent portion of the border strip 26.

This type of fastening the fabric sheets 14 also results in a web-like portion 30 of the border strip 26 remaining free which projects from the outer surface of the side members 22*a* to 22*d*, as can be seen in FIG. 3.

In the embodiment shown in FIG. 4, initially a fusion adhesive strand 38 is introduced into the circular, undercut groove 34 and, subsequently, the border strip 26 of the fabric sheet 14 is pressed against the adhesive. By means of a suitable tool, for example, a tool of the type of a flat iron, the fusion adhesive strand 38 can be heated and, thus, the connection to the border strip 26 of the fabric sheet 14 can be effected. Also in this case, the glued connections may be located in such a way that web-like portions 30 of the border strips 26 remain free and project from the outer surface of the rectangular frame 12 formed by the section walls 18.

Figure 5:
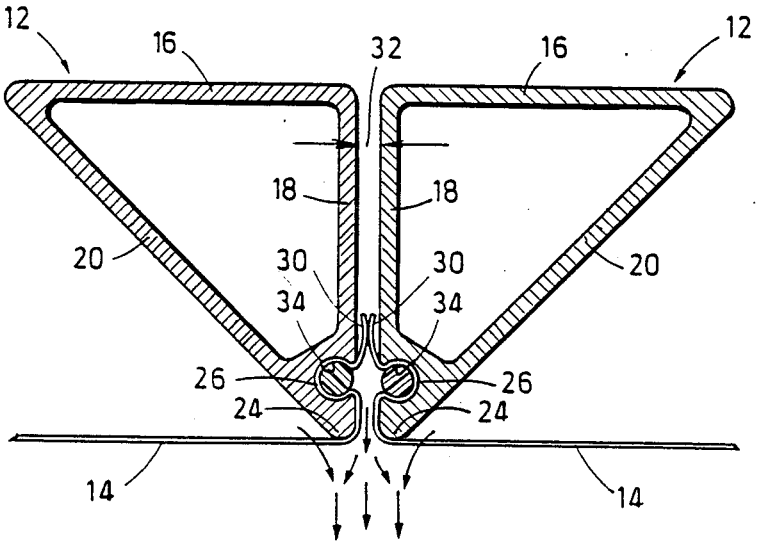
FIG. 5 is a sectional view of two parallel side members of the type shown in FIGS. 3 and 4 of two adjacent laminarizers.

FIG. 5 shows in an illustration corresponding to that of FIG. 1 the mounted positions of two adjacent rectangular frames 12 of the type shown in FIGS. 3 and 4. As FIG. 5 also shows, a gap 32 exists in which the two web-like portions 30 of the border strips 26 contact each other in such a way that a defined permeability is created which serves to create a laminar flow pattern even immediately behind the vertex zones 24, i.e., an undesired turbulent flow is essentially prevented.

Figure 6:
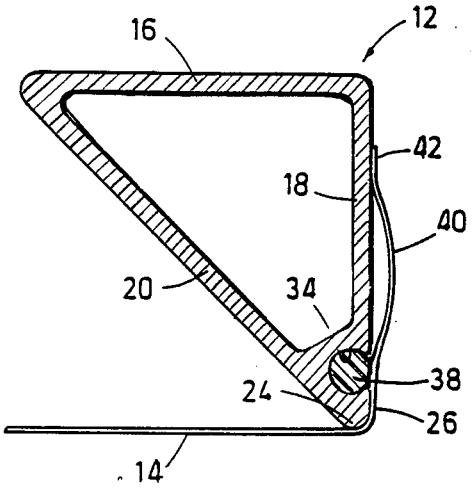
FIG. 6 is a further development of the side member shown in FIG. 3.

The embodiment shown in FIG. 6 differs from the one of FIG. 4 essentially only in that the border strip 26 of the fabric sheet 14 has a width which corresponds almost to the width of the section wall 18 of the side members 22*a* to 22*d*. However, instead of the web-like free portions 30, a strip portion 40 is provided which is fastened near its longitudinal edge by means of an additional glued connection 42 in such way that an arched portion is created which is spaced from the section wall 18 which forms the outer surface of the rectangular frame 12.

Figure 7:
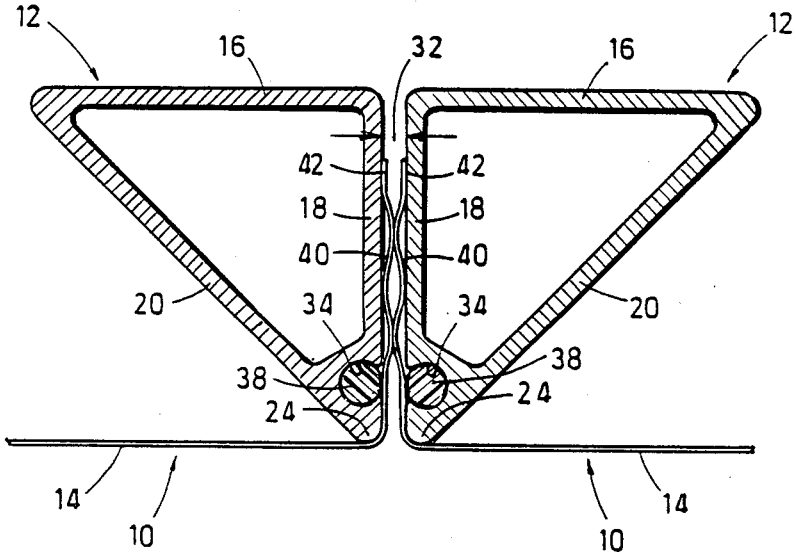
FIG. 7 is a sectional view of two parallel side members of the type shown in FIG. 6 of two adjacent rectangular members.

If two laminarizers 10 of the type shown in FIG. 6 are mounted next to each other as shown in FIG. 7, the strip portions 40 come into contact with each other over a substantial width and may assume an undulated shape. This results in a further improved, defined permeability in the region of the gap 32 between adjacent laminarizers 10.

Figure 8:
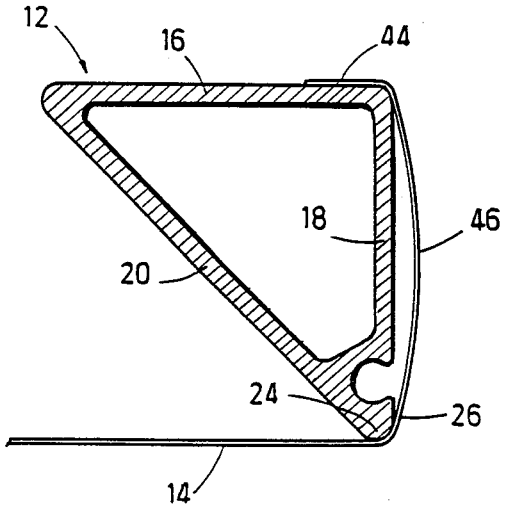
FIG. 8 is another further development of the side member shown in FIG. 3.
Figure 9:
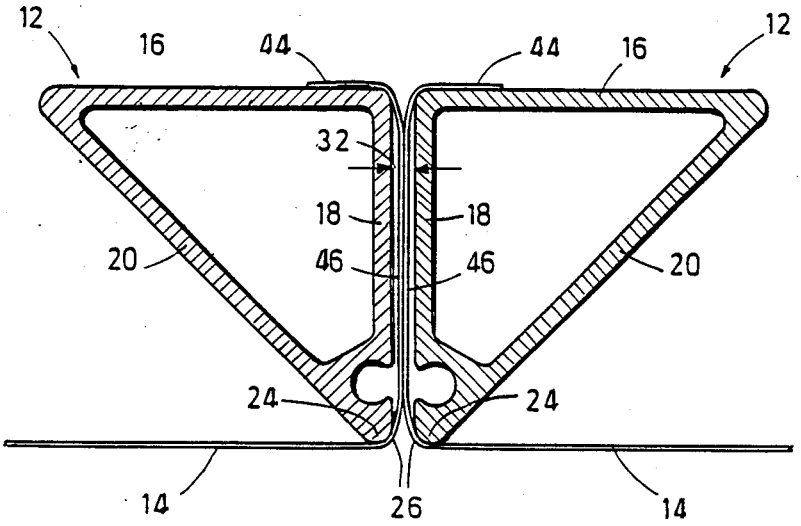
FIG. 9 is a sectional view of two adjacent laminarizers with rectangular frames having side members of the type shown in FIG. 8.

In the embodiment shown in FIG. 8, the width of the border strip 26 of the fabric sheet 14 is selected in such a way that the border strip 26 can be placed over the entire width of the section wall 18 against the outer surface of the side member 22*a* to 22*d* of the rectangular frame 12 and that, moreover, a portion of the width of the section wall 16 is covered. In this case, only the portion 44 of the border strip 26 is fixedly glued to the rear surface formed by the section wall 16, while the portion 46 adjacent the section wall 18 is not fixed, so that portion 46 may assume a slight arch shape.

When two laminarizers 10 of the type shown in FIG. 8 are placed immediately next to each other, the two portions 46 come into contact with each other in the gap 32 over a large area and, thus, determine the defined permeability through the gap 32 toward the room interior.

FIG. 10 of the drawing shows in an exaggerated representation that the four side members 22*a*, 22*b*, 22*c* and 22*d* of the rectangular frame 12 are connected to each other by means of four corner pieces 48. The corner pieces 48 have legs 50 and 52 which are forced with press fit into the open ends of the hollow sections forming the side members 22*a* through 22*d*. As can be seen in the drawing, the legs 50 and 52 of each corner piece 48 include an angle which is slightly greater than 90°. The angle is preferably between 90°10′ and 90°20′. As a result, the side members 22*a* through 22*d* of the finished rectangular frame 12 are elastically pretensioned which leads to a slight convex or outwardly arched deformation of the side members as indicated by solid lines in FIG. 10.

When fabric sheets 14 are stretched over such a prefabricated rectangular frame 12, an elastic deformation of the side members 22*a* through 22*d* back approximately into the position indicated by broken lines occurs and an excellent permanent stretching of the fabric sheets 14 is obtained.

Figure 12:
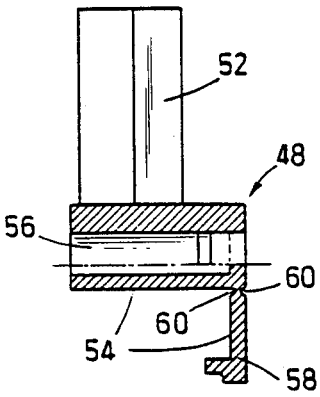
FIG. 12 is a sectional view taken along sectional line XII—XII of FIG. 11.
Figure 11:
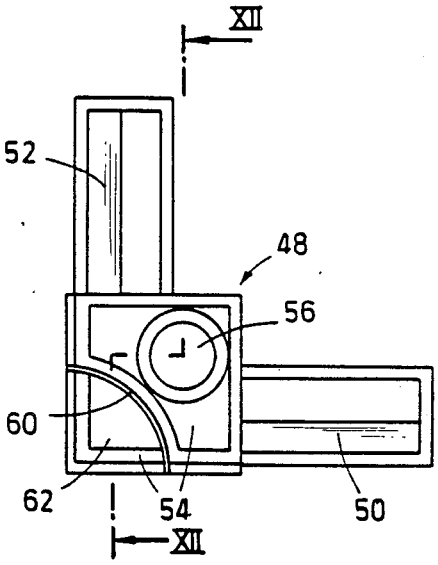
FIG. 11 is a view of a detail identified at XI in FIG. 10.

The structure of the corner pieces 48 for assembling the frame 12 is shown in detail in FIGS. 11 and 12.

As is apparent from FIGS. 11 and 12, the corner pieces 48 preferably are injection molded pieces of plastics material or die cast pieces of metal and, therefore, have a stable shape while requiring a small amount of material. In addition to the two legs 50 and 52, each corner piece 48 has a middle portion 54 of approximately square shape. A passage duct 56 is formed in the middle portion 54. The duct 56 is located adjacent the inner corner region of the middle portion 54 and serves to receive a fastening means of the rectangular frame.

In its outer corner region, the middle portion 54 has quarter-circle shaped intended breaking points 60 in a wall portion 58 extending parallel to the plane of the frame. Corresponding break-out areas 62 are defined by the intended breaking points 60.

Four adjacent break-out areas 62 form a circular passage as it is required, for example, for supplying energy or other media. Thus, the connecting lines for sprinkler heads can be mounted without problems in the circular passages when the laminarizers 10 are already mounted.

Figure 13:
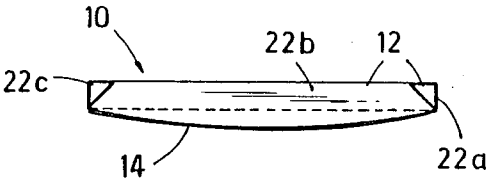
FIG. 13 is a schematically simplified illustration of a fully assembled laminarizer.

As indicated in FIG. 13 of the drawing, it may be an advantage if the fabric sheets 14 are pretensioned in the rectangular frame 12 only to such an extent that the sheets sag and assume an arched shape, thus deviating to a certain extent from the plane of the rectangular frame 12. It has been found particularly advantageous if the fabric sheets 14 are pretensioned in such a way that the sagging from the plane of the rectangular frame 12 is between 20 and 30 mm. This not only increases the service life of the laminarizers 10, but also favorably influences the laminar piston-type flow within a room.

A fastening device 64 is used for suspending the laminarizers 10 through the corner pieces 48 easily and without problems, for example, from a room ceiling. The fastening device 64 is of conventional construction and includes suspension rods or tensioning rods 65 to the lower ends of which is connected a support plate 66.

The support plate 66 has fastening means 68 for a corner each of four adjacently arranged rectangular frames 12. Each fastening means 68 is received in a cage 70 on the support plate 66 in such a way that the fastening means 68 can be moved to a limited extent in longitudinal direction and transverse direction.

The fastening means advantageously are nuts which are fastened in the cages 70 so as to be non-rotatable but slidable in two directions.

The fastening means 68 can also be constructed in such a way that they make possible an interaction with quick-acting closing means, for example, in the form of annular or bayonet-type closing means.

If the fastening means 68 are nuts, the nuts can be connected to screws which may be inserted through the passage ducts 56 of the corner pieces 48.

As already mentioned above, the laminarizers 10 supported by the fastening devices 64 are usually mounted at a distance in front of filter modules of clean room ceilings and walls.

The mechanical filters of such filter modules are supported and fixed by means of so-called band-type screens. These screens are also supported by the fastening devices 64.

Figure 14:
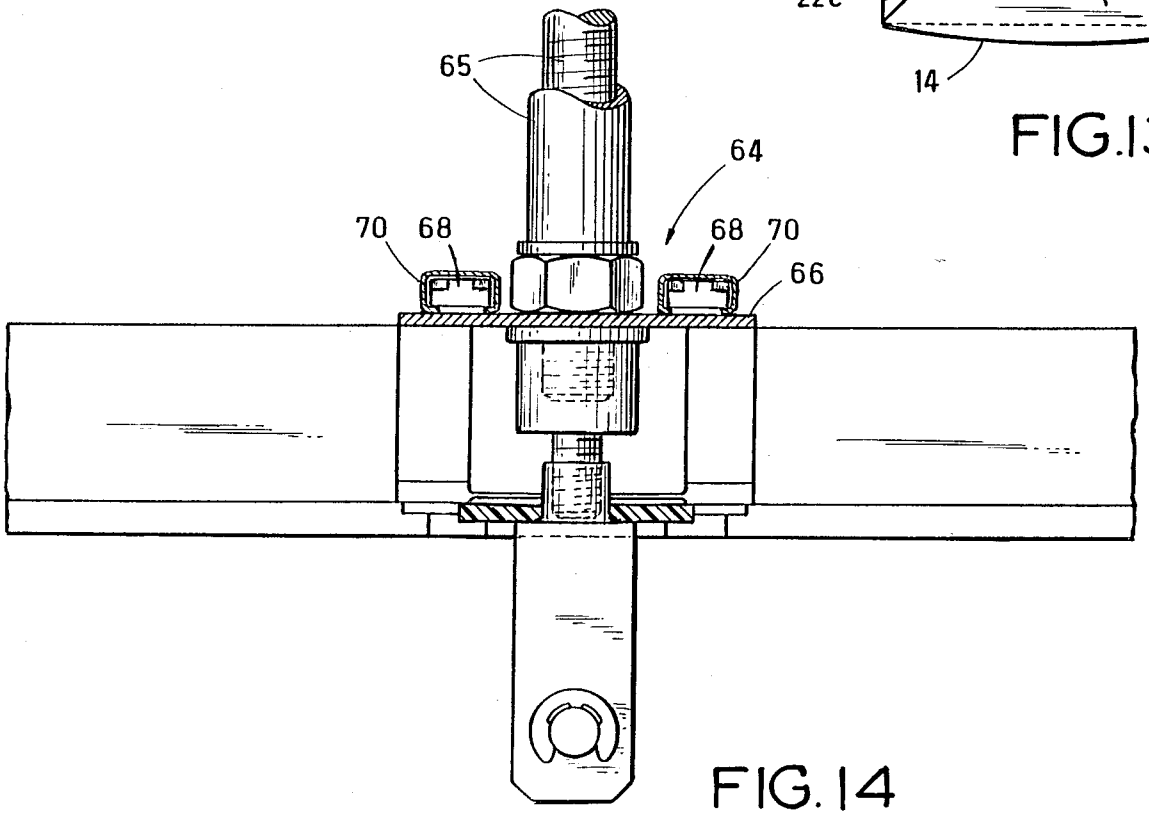
FIG. 14 is a vertical section showing details of the device for suspending laminarizers.
Figure 15:
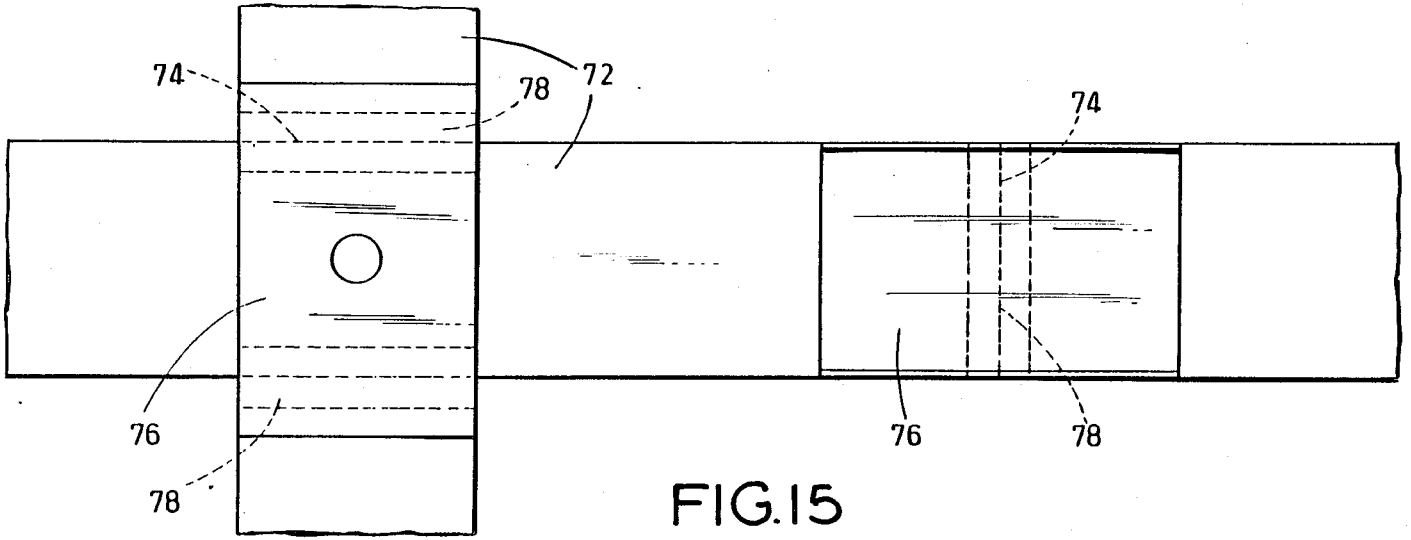

Such a screen 72 is schematically in FIGS. 14 and 15.

Figure 16:
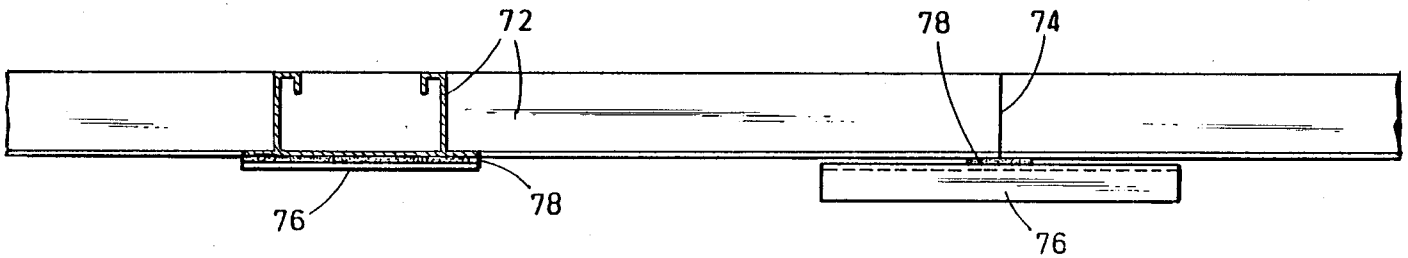

To ensure that the screens 72 are of air-tight construction, the joints 74 are sealed by means of sheet metal sheets glued to the bottom of the screens. FIG. 16 shows the adhesive layer 78 which performs the actual sealing action.

While specific embodiments of the invention have been shown and described in detail to illustrate the application of the inventive principles, it will be understood that the invention may be embodied otherwise without departing from such principles.

We claim:

1. In a laminarizer for producing laminar flow for ceilings and walls of clean rooms formed of filter modules, the laminarizer being suspended or held spaced from a cover supporting mechanical filters, the laminarizer including rectangular frames with fabric sheets being stretched onto each rectangular frame, each rectangular frame defining a plane and having side members, each side member being a section of triangular cross-section, the side members each having a surface facing the room, an outer surface extending perpendicularly to the plane of the frame, and a rear surface extending in the plane of the rectangular frame, the fabric sheets resting against and being aligned by the surfaces of the side members facing the room, the improvement comprising the surfaces of the side members facing the room defining narrow alignment contact means for the fabric sheets, the fabric sheets being fastened to the side members at the outer surfaces of the side members.

2. In a laminarizer for producing laminar flow for ceilings and walls of clean rooms formed of filter modules, the laminarizer being suspended or held spaced from a cover supporting mechanical filters, the laminarizer including rectangular frames with fabric sheets being stretched onto each rectangular frame, each rectangular frame defining a plane and having side members, each side member being a section of triangular cross-section, the side members each having a surface facing the room, an outer surface extending perpendicularly to the plane of the frame, and a rear surface extending in the plane of the rectangular frame, the fabric sheets resting against and being aligned by the surfaces of the side members facing the room, the improvement comprising the surfaces of the side members facing the room defining narrow alignment contact means for the fabric sheets, the fabric sheets being fastened to the side members at the rear surfaces of the side members.

3. The laminarizer according to claims 1 or 2, wherein the fabric sheets are fastened to the outer surfaces and the rear surfaces of the side members.

4. The laminarizer according to claims 1 or 2, wherein the sections are hollow sections.

5. The laminarizer according to claims 1 or 2, wherein the sections are angle sections.

6. The laminarizer according to claims 1 or 2, wherein the alignment contact means are rounded off.

7. The laminarizer according to claims 1 or 2, wherein the fabric sheets are connected by means of a glued connection.

8. The laminarizer according to claim 7, wherein the glued connection is a surface-to-surface connection.

9. The laminarizer according to claims 1 or 2, wherein each side member defines a longitudinal indentation with an opening, an adhesive strand being placed in each longitudinal indentation, the adhesive strand being connected to the fabric sheet at the opening of the longitudinal indentation.

10. The laminarizer according to claim 9, wherein the adhesive strand is of a fusion adhesive.

11. The laminarizer according to claim 9, wherein the longitudinal indentation is an undercut groove.

12. The laminarizer according to claims 1 or 2, wherein each side member has a longitudinal indentation, the fabric sheet being releasably fastened by means of a rim profile or sealing profile placed in the longitudinal indentation.

13. The laminarizer according to claim 12, wherein the longitudinal indentation is an undercut groove.

14. The laminarizer according to claim 12, wherein each rim profile includes a sealing lip formed integrally with the rim profile, the sealing lip projecting from the outer surface of the side member.

15. The laminarizer according to claims 1 or 2, wherein the fabric sheets have border edges, each fabric sheet being fastened to the side member at a distance from the border edge of the sheet, so that an unfastened border strip of the fabric sheet is formed, the unfastened border strip extending web-like from the outer surface of the side member.

16. The laminarizer according to claim 15, wherein the web-like border strip of the fabric sheet projects into a gap between adjacent rectangular frames, the web-like border strips contacting each other within the gap, so that a defined permeability is produced in the gap.

17. The laminarizer according to claims 1 or 2, wherein the fabric sheets have border edges, each fabric sheet being fastened to the side member at a distance from the border edge of the sheet, so that an unfastened border strip of the fabric sheet is formed, the unfastened border strip extending arc-shaped from the outer surface of the side member.

18. The laminarizer according to claim 17, wherein the web-like border strip of the fabric sheet projects into a gap between adjacent rectangular frames, the arc-shaped border strips contacting each other within the gap, so that a defined permeability is produced in the gap.

19. The laminarizer according to claims 1 or 2, wherein the fabric sheet is attached to the rectangular frame such that the fabric sheet sags in an arch-like shape from the plane of the rectangular frame, the height of the arch of the fabric sheet being approximately between 20 and 30 mm.

20. The laminarizer according to claims 1 or 2, wherein the rectangular frame side members are connected to each other by means of corner angles, the corner angles having legs which are angularly spaced from each other by between 90° and 91°, the side members being connected to each other so as to be under convex, outwardly arched elastic pretensioning.

21. The laminarizer according to claim 20, wherein the legs are angularly spaced from between 90°10′ and 90°20′.

22. The laminarizer according to claim 20, wherein the legs of the corner angles are held together with the side members in a press fit connection.

23. The laminarizer according to claim 20, wherein the corner angles each have in an outer corner region thereof a wall portion which extends parallel to the plane of the rectangular frame, each wall portion being provided with a quarter-circle shaped intended breaking point defining a limited break-out area.

24. The laminarizer according to claims 1 or 2, the laminarizer being fastened to a ceiling by means of rods, a support plate being attached to the rods, the support plate effecting releasable engagement of adjacent corners of the rectangular frames, the support plate having an engagement means for a corner each of the four adjacent rectangular frames, the engagement means being provided on the support plate so as to be slidable in longitudinal direction and transverse direction by a limited extent.

25. The laminarizer according to claim 24, wherein each engagement means includes a nut movable in a cage, the side members of the rectangular frame being connected by means of corner angles, screws extending through the corner angles being screwed into the nuts.

26. The laminarizer according to claim 24, wherein carrying plates for band-type screens formed of sheet metal sections are attached to the rods, the screens receiving cover plates by means of which the frames of the mechanical filters for the filter modules can be covered, the screens including joint being sealed by a sheet metal sheet glued to the bottom of the screen.

* * * * *